US005305624A

United States Patent [19]

Backhaus

[11] Patent Number: 5,305,624

[45] Date of Patent: Apr. 26, 1994

[54] SIZING-STAND GROUP

[75] Inventor: Karl Backhaus, Duisburg-Baerl, Fed. Rep. of Germany

[73] Assignee: Mannesmann Aktiengesellschaft A Corp. of the Federal Republic of Germany, Dusseldorf, Fed. Rep. of Germany

[21] Appl. No.: 887,275

[22] Filed: May 22, 1992

[30] Foreign Application Priority Data

May 22, 1991 [DE] Fed. Rep. of Germany ..... 4117054

[51] Int. Cl.[5] ..... B21B 1/18; B21B 37/12

[52] U.S. Cl. ..... 72/12; 72/235

[58] Field of Search ..... 72/9, 10, 12, 234, 235

[56] References Cited

U.S. PATENT DOCUMENTS 3,733,866 5/1973 Arimura et al. ..... 72/6

3,996,776 12/1976 Bryant et al. ..... 72/9

*Primary Examiner*—Lowell A. Larson

*Assistant Examiner*—Thomas C. Schoeffler

*Attorney, Agent, or Firm*—Cohen, Pontani, Lieberman, Pavane

[57] ABSTRACT

A method and an apparatus for obtaining narrow tolerances of accuracy to shape and size of a rolled product rolled in a wire mill and/or bar mill including at least two sizing stands of high stiffness wherein, with the exception of the last stand, the stands are adjustable under load. The stands cooperate with a device for determining the geometrical data of the rolled product, as well as the relevant rolling operation data. The device is mounted in front of the next-to-last stand for detecting the geometrical data of the rolled product before it enters into the next-to-last stand. The measured values are processed with a sizing model for obtaining a desired exact profile shape in the last roll stand in a computer for forming a signal which is used for adjusting the next-to-last stand.

8 Claims, 1 Drawing Sheet

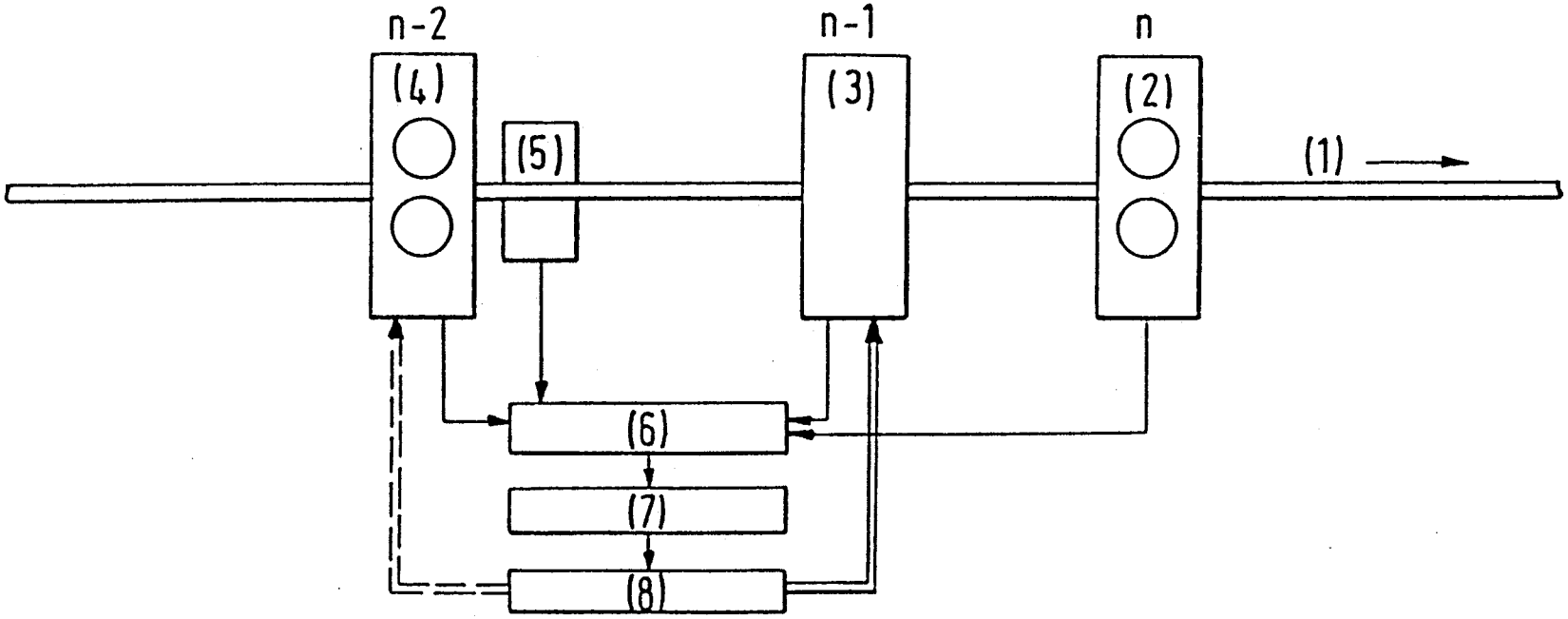
(1)
n
(2)
n-1
(3)
n-2
(4)
(5)
(6)
(7)
(8)

SIZING-STAND GROUP

BACKGROUND OF THE INVENTION

1. Field of the Invention

The present invention relates to a method for obtaining narrow tolerances of the accuracy to shape and size of a product rolled in a wire mill and/or bar mill with the use of at least two sizing stands of high stiffness which, with the exception of the last stand, are adjustable under load. The stands cooperate with means for detecting the geometrical data of the rolled product and relevant rolling-operation data of the product, as well as with a computer in which a signal is calculated from stored data and measured data, wherein the signal is used to correct the adjustment of at least one of the stands.

The present invention also relates to an apparatus for carrying out the above-described method.

2. Description of the Related Art

The automatic control of rolling trains, particularly for rolling sheet products, is known. In sheet rolling trains, for example, the thickness of the product is measured continuously or periodically and the roll gap of one or more roll stands of the rolling train is changed on the basis of the measurement in accordance with a mathematical algorithm in order to obtain a product of the desired thickness.

When rolling sections, control of the train is more complicated. The change in the roll gap has more influence than in the case of a sheet on the circumferential dimension of the section, i.e., the width of the section changes. Effects of changes of diameter in longitudinal direction, for instance due to eccentricity of the rolls, changes in temperature in the rolled product, and changes in tensile stress or wear, can only be insufficiently compensated. This is because, in the known methods for controlling section rolling mill trains, the geometrical data of the rolled product are detected in order to determine an optimum correction in a computer on the basis of the relevant rolling operating data stored therein. However, the detection of the geometrical data takes place only behind the last stand of the train. As a result, mistakes can only be compensated after they have already occurred, so that a considerable part of the rolled product produced cannot comply with the necessary tolerance values (Federal Republic of Germany 28 11 778).

Because of the detection of differences in tolerance only behind the finishing stand, higher demands had to be placed on the preliminary cross section, particularly if-as is also known-the group of finishing stands has been operated with two rigid grooves. The temperature differences over the length of the bar also had to be kept very small in order to achieve results which comply with the tolerance. Even if the finishing stand were made adjustable, it could not be prevented that errors could only be corrected after they had already occurred.

SUMMARY OF THE INVENTION

Therefore, it is the object of the present invention to provide a method, and an apparatus for carrying out the method, for obtaining narrow tolerances of the accuracy to shape and size of a rolled product rolled in a wire and/or bar mill with which entering errors in thickness caused, for instance, by tension adjustment and temperature errors can be removed at an early time so as to obtain from the final stand and a rolled product of optimum tolerance accuracy.

In accordance with the invention, this object is met by determining the geometrical data of the entering product as well as the relevant rolling data before the next-to-last sizing stand and processing the determined values in the computer by means of a sizing model which seeks to obtain the exact profile shape in the last rolling stand, possibly with the use of an empirical control principle, to form the signal by means of which at least the next-to-last sizing stand is adjusted.

In contrast to the prior art, the method according to the invention does not permit rolled products to leave the sizing group outside of the tolerance. The gist of the inventive concept resides in maintaining constant the volumetric flow supplied to the last stand, by determining the geometrical data of the rolled product already prior to the next-to-last rolling stand and using the data for the optimum setting of the groove of the next-to-last stand. The sizing of this stand is selected such that no change in the groove cross section is necessary in the last rigid groove, i.e. an exact profile shape results in the last groove. In order to achieve this, a computer-assisted sizing model is used which, possibly widened by means of an empirical control principle, calculates the optimum setting of the corresponding roll stand and gives it off as a signal to the setting device.

Using this concept, very close size tolerances (diameter and dimensions) as well as very close shape tolerances (roundness or orthogonality) are obtained in wire mills and bar mills. Entering errors in thickness as a result of an adjustment of tension in the preceding rolling steps can be eliminated. Deviations in dimensions which are caused by temperature errors in the operation of the furnace and in the temperature wedge in the rolling train can also be eliminated.

In addition, it is provided that, in order to adapt to the variable conditions of the rolling train, an adaptation of the stored calculation parameters can be effected.

In the apparatus for carrying out the above-described method, the sizing stands include at least two, preferably three, stands with single-groove rolls. In front of the next-to-last stand is provided a measuring device for detecting the geometrical dimensions of the rolled product before entrance into the next-to-last stand.

In order to obtain the narrowest tolerances to shape and size, a stand construction of the highest possible stiffness is to be used. In addition to conventional stands, stands without housings are also considered. In order to reduce bending of the rolls, single-groove rolls are used with small body width. Furthermore the roll dimensions can be established accordingly in order to support these measures.

In a further development of the invention, a tension control can be used between the sizing stands for large dimensions (large diameters) while for small dimensions (small diameters) a loop control may be preferred. Of course, a rigid adjustment of the speed of rotation can also be employed between the last two stands.

It has been found advisable, in order to produce round cross sections, for the stands to be set up in a horizontal/vertical arrangement and to be sized alternately oval/round, wherein the last sizing stand, which is not adjustable under load, has a round groove.

The method and apparatus of the invention can be used both within a train of the type described above and also as finishing step. The invention takes into account the increasing demands on close manufacturing tolerances of rolled products and accuracy of the dimensions over the length of the product.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there is illustrated and described a preferred embodiment of the invention.

BRIEF DESCRIPTION OF THE DRAWING

In the drawing:

The single Figure of the drawing schematically illustrates a group of finishing stands of a wire and bar mill and the control means for carrying out the method of the invention.

DESCRIPTION OF THE PREFERRED EMBODIMENT

As shown in the drawing, the sizing-stand group consists of three stands 2, 3, and 4 (n, n-1, and n-2). Stands 2 (n) and 4 (n-2) have a round groove and stand 3 (n-1) has an oval groove. The last stand 2 (n) in the direction of rolling is not adjustable under load in order to obtain a particularly stiff construction. In all stands single-groove rolls are preferably employed.

Stands 3 (n-1) and 4 (n-2) are adjustable under load, but also have a construction of high stiffness. For producing round cross sections, stands 4 to 2 are provided in a horizontal/vertical/horizontal arrangement. However, the arrangement may also be vertical/horizontal/-vertical depending on the existing mill design.

When the rolled product 1 is passed through the sizing stands, the temperature and the geometrical data of the rolled product 1 are determined by a measuring device 5 directly behind the sizing stand 4 (n-2). Together with relevant roll-operating data of the sizing stands, the obtained data are fed to a measured-value recording system 6.

The measured data are transferred to a computer system 7 having groove models and to an adaption system with stored calculation parameters. Thus an optimum correction of the stand adjustment is determined at least of stand 3 (n-1), and optionally also of other stands.

The calculated control data are fed to a desired-value output 8 for correction of the setting of the next-to-last sizing stand or also of other stands.

Since the relevant rolling operating data are detected in front of the next-to-last sizing stand, entering thickness errors as a result of a tension control in the preceding rolling steps can be limited by the method according to the present invention. Deviations in dimension which are caused by temperature errors in the furnace operation and the temperature wedge in the rolling train can also be eliminated.

It should be understood that the preferred embodiment and examples described are for illustrative purposes only and are not to be construed as limiting the scope of the present invention which is properly delineated only in the appended claims.

I claim:

1. A method for obtaining narrow tolerances of accuracy to shape and size of a rolled product, rolled in a wire mill or a bar mill, including at least two successively arranged sizing stands of high stiffness, wherein the stands include stands that are adjustable under load and a last stand that is not adjustable under load, the method comprising: measuring geometrical data of the rolled product and relevant rolling data before the rolled product enters the next-to-last sizing stand: processing the measured data in a computer, forming in the computer a signal from stored data and the measured data by means of a sizing model for obtaining a desired exact profile shape in the last sizing stand: and utilizing the signal for adjusting at least the next-to-last sizing stand.

2. The method according to claim 1, comprising utilizing an empirical control means for forming the signal in the computer.

3. The method according to claim 1, comprising adapting stored calculation parameters for effecting adaptation to variable operating conditions of the wire mill or a bar mill.

4. An apparatus for obtaining narrow tolerances of accuracy to shape and size of a rolled product in a wire mill or a bar mill, including at least two successively arranged sizing stands of high stiffness with single-groove rolls, wherein the stands include stands that are adjustable under load and a last stand that is not adjustable under load, the apparatus comprising: a measuring device mounted in front of the next-to-last stand for measuring geometrical dimensions of the rolled product before it enters into the next-to-last: and means for processing the measured geometrical dimensions of the rolled product in a computer with a sizing model for obtaining a desired exact profile shape in the last sizing stand, wherein the processing means includes a means for forming a signal for adjusting at least the next-to-last sizing stand.

5. The apparatus according to claim 4, wherein the wire mill or a bar mill includes three sizing stands with single-groove rolls.

6. The apparatus according to claim 4, wherein the sizing stands are tension-regulated.

7. The apparatus according to claim 4, comprising a loop control between the sizing stands.

8. The apparatus according to claim 4, wherein, for producing round cross sections, the successive sizing stands are arranged in a horizontal/vertical configuration and alternatingly with oval grooves and round grooves, wherein the last sizing stand has a round groove.

* * * * *